United States Patent [19]

Steinkamp et al.

[11] 4,314,961

[45] Feb. 9, 1982

[54] METHOD FOR HOT PRESSING IRREGULARLY SHAPED REFRACTORY ARTICLES

[75] Inventors: William E. Steinkamp, Clinton; Ambrose H. Ballard, Knoxville, both of Tenn.

[73] Assignee: The United States of America as represented by the Department of Energy, Washington, D.C.

[21] Appl. No.: 48,331

[22] Filed: Jun. 14, 1979

Related U.S. Application Data

[62] Division of Ser. No. 871,872, Jan. 24, 1978, abandoned.

[51] Int. Cl.[3] ..... B29C 3/06

[52] U.S. Cl. ..... 264/325; 264/332

[58] Field of Search ..... 264/325, 332

[56] References Cited

U.S. PATENT DOCUMENTS 1,918,064 9/1930 Taylor ..... 425/78
2,342,772 2/1944 Wellmon ..... 425/78
3,201,235 8/1965 Mueller ..... 425/352
3,732,056 5/1973 Eddy et al. ..... 425/352

*Primary Examiner*—John A. Parrish
*Attorney, Agent, or Firm*—Earl L. Larcher; Stephen D. Hamel; James E. Denny

[57] ABSTRACT

The present invention is directed to a method for hot pressing irregularly shaped refractory articles with these articles of varying thickness being provided with high uniform density and dimensional accuracy. Two partially pressed compacts of the refractory material are placed in a die cavity between displaceable die punches having compact-contacting surfaces of the desired article configuration. A floating, rotatable block is disposed between the compacts. The displacement of the die punches towards one another causes the block to rotate about an axis normal to the direction of movement of the die punches to uniformly distribute the pressure loading upon the compacts for maintaining substantially equal volume displacement of the powder material during the hot pressing operation.

3 Claims, 6 Drawing Figures

METHOD FOR HOT PRESSING IRREGULARLY SHAPED REFRACTORY ARTICLES

This invention was made in the course of, or under, a contract with the U.S. Department of Energy.

This is a division of application Ser. No. 871,872, filed Jan. 24, 1978 abandoned.

The present invention relates generally to the hot pressing of particulate material into highly dense articles, and more particularly to a method for hot pressing irregularly shaped refractory articles which are characterized by essentially uniform density and dimensional accuracy.

Refractory articles of near uniform and complete densification have been fabricated by employing well-known hot pressing techniques which utilize movable die punches. The configurations of these articles as provided by such previously known hot pressing equipment have been limited to configurations of near uniform dimensions, such as typified by cubes, cylinders, and rectangular configurations. It has been found that if the finished refractory article is to have irregular cross sectional dimensions, i.e., with varying cross sectional thicknesses, such as a turbine stator or blade or an air foil, that a structure of regular uniform cross sectional dimensions must first be formed by employing the conventional hot pressing techniques. This hot pressed structure is then machined or ground into the particular configuration required of the finished article. The expense and time involved for forming these irregular-shaped articles of refractory material is often prohibitive, especially in applications where relatively large numbers of the articles are required.

Hot pressing irregularly shaped articles to substantially full and uniform density by employing known die-pressing techniques involves several problems. For example, an irregularly shaped compact cold-pressed to approximately 50 percent density and with a thickness variation of about twice the thickness at one end as in another is positioned in a die cavity with a die punch or punches configured to conform with the configuration of the compact. Displacing the die punches a distance sufficient to achieve one-half the volume reduction in the thinner end will press the latter to full density while the thicker end will only be pressed to about three-fourths the full density. Therefore, in order to achieve full density over the entire compact, material from the thinner end must flow from the thinner end into the thicker end to obtain complete densification of the latter. However, the low plasticity of most refractory materials does not allow for this flow to uniformly occur. Apparently, the basic reason for flowing or redistributing the particulate material during a pressing operation is due to volume displacement disparity which effects a non-uniform pressure distribution throughout the compact. Hence, it is very difficult to achieve a full and uniform density across an irregularly shaped compact by using previously known hot pressing apparatus and techniques.

Accordingly, it is the primary goal or aim of the present invention to obviate or substantially minimize the problems heretofore encountered in hot pressing irregularly shaped refractory articles to uniform density and dimensional accuracy. To achieve this goal, two similarly shaped and partially densified compacts of the refractory material are disposed within a die cavity and arranged so that the thicker portions of the compact are positioned contiguous to the thinner portion of the other compacts. The die punches displaceable at each end of the die cavity have compact-contacting surface portions of a configuration corresponding to that of the desired article configuration. A floating block of an essentially non-compressible material is placed between the compacts and rotated about an axis normal to the axis of displacement of the die punches by the movement of the latter toward one another. This rotation of the floating block effects a uniform distribution of the pressure load upon the compacts for maintaining a substantially equal volume displacement of the particulate material during the pressing operation so as to obtain substantially full densification of the compacts. In other words, if the thicker section is twice the thickness of the thinner section, the floating block will cause the particulate material to be compressed at a rate approximately twice that of the thinner section so that upon complete displacement of the die punches the densification of the particulate material is uniform throughout the entire volume thereof.

The refractory materials from which the articles may be shaped to substantially full density include carbides, oxides and nitrides of tungsten, zirconium, silicon, aluminum and chromium, and suitable refractory metals such as tungsten, niobium, tantalum, molybdenum, vanadium, zirconium, hafnium, and mixtures thereof.

Other and further objects of the invention will be obvious upon an understanding of the illustrative embodiments about to be described, or will be indicated in the appended claims, and various advantages not referred to herein will occur to one skilled in the art upon employment of the invention in practice.

Embodiments of the invention have been chosen for the purpose of illustration and description. The embodiments illustrated are not intended to be exhaustive or to limit the invention to the precise form disclosed. They are chosen and described in order to best explain the principles of the invention and their application in practical use to thereby enable others skilled in the art to best utilize the invention in various embodiments and modifications as are best adapted to the particular use contemplated.

Figure 1:
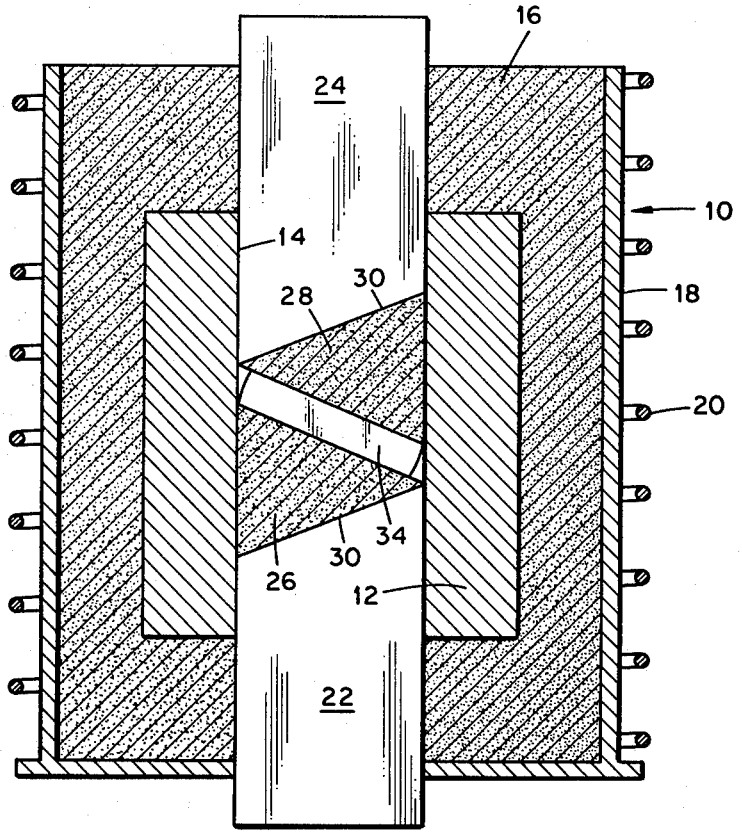
FIG. 1 is a somewhat schematic elevational sectional view of a hot pressing furnace with the floating block and die punch arrangement of the present invention shown in the die cavity prior to the initial hot pressing of the confined irregularly shaped compacts.
Figure 2:
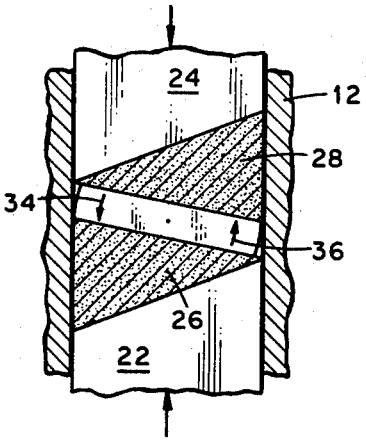
FIG. 2 is a schematic illustration showing an intermediate position of the die punches and the floating block during the pressing operation.
Figure 3:
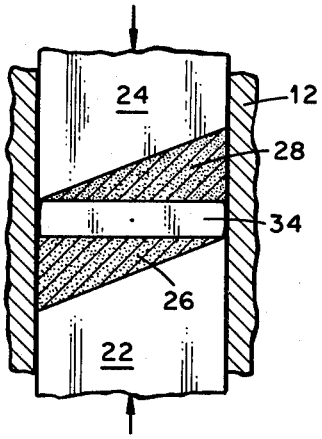
FIG. 3 is a schematic illustration showing the final position of the floating block after the rotation thereof for achieving the essentially full densification of the irregularly shaped compacts within the die cavity.

Referring now to FIGS. 1–3, a hot press furnace 10 in which the present invention may be practiced is shown. The hot press furnace 10 houses a die 12 of a cylindrical or any other desired configuration which may be formed of graphite or a refractory material and which has a through-going passageway or die cavity 14 therein. The die 12 is enclosed within suitable insulating material 16 which encompasses a projection of the die cavity 14 for maintaining the die 12 at substantially uniform temperatures during the pressing operation. This insulating material 16 is, in turn, enclosed within a casing 18. Heating means 20, such as induction coils or water-cooled R.F. coils may be utilized for heating the enclosed die 12 to the temperature necessary to sinter together the particulate refractory material confined within the die cavity.

The load necessary to press the refractory material within the die 12 is provided by a double-acting die punch assembly with die punches 22 and 24 which are displaceable towards one another along the longitudinal axis of the die cavity 14. This displacement of the die punches may be achieved by employing conventional hydraulic jacks and rams. Two partially irregularly shaped compacts 26 and 28 of the refractory material which have been cold pressed to about 50 percent of full density are placed within the die cavity 14 between the die punches 22 and 24. These compacts are of cross sections of varying thicknesses and are positioned in the die cavity 14 so that the thicker portions of one compact are contiguous with and generally mate with the thinner portions of the other compact, such as shown in FIG. 1. The die punches 22 and 24 are in turn provided with surface portions or faces 30 and 32 which respectively conform to configuration desired of the finished article.

Intermediate the irregularly shaped compacts 26 and 28 there is disposed a floating and rotatable block 34 formed of graphite or refractory material which is essentially non-compressible so as to retain its shape under the pressure loadings applied by the die punches. Each face of this floating block 34 in contact with a compact is of a configuration conforming to that desired of the article and is of a diameter essentially corresponding to that of the die cavity 14. The floating block 34 is initially positioned between the compacts 26 and 28 at an angle departing from the longitudinal axis of the cavity due to the configuration and position of the compacts in the die cavity. The thicker portions of the compacts must be displaced a greater distance and a greater rate within the die cavity than the thinner portions in order to provide substantially full and uniform densification of the entire compact. This greater displacement of the thicker portions of the compacts is provided by the rotation of the block 34 about an axis perpendicular to the longitudinal axis of the cavity as indicated by arrows 35 until the blocks 34 are disposed in a plane substantially perpendicular to the longitudinal axis of the cavity, as shown in FIG. 3. This rotation of block 34 during the pressing of the compacts 26 and 28 is in a direction towards the thicker portion of the compact to insure that the compaction of the particulate material providing the compact will be essentially uniform throughout the entire article since block rotation will minimize the displacement of the particulate material from the denser to the less dense portions of the compacts as previously required.

Figure 4:
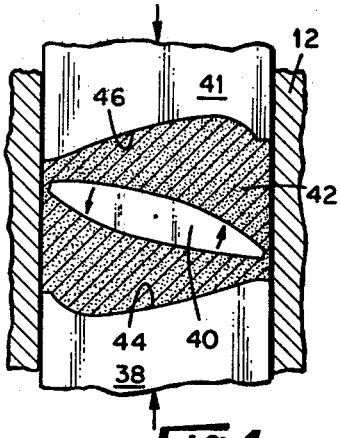
FIG. 4 is a schematic illustration showing the fabrication of a turbine blade by employing the apparatus and method of the present invention.
Figure 6:
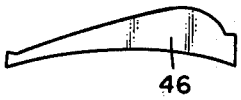
FIG. 6 shows an end view of the completed stator blade.
Figure 5:
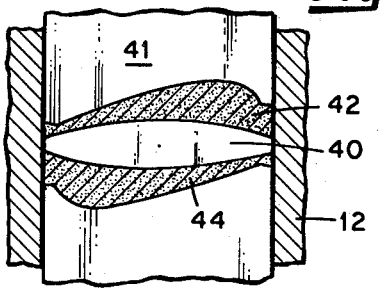
FIG. 5 illustrates the positions of the floating block and die punches as they would appear upon the completion of the hot pressing operation.

The present invention may be utilized to form stator blades for turbines from refractory material. As shown in FIGS. 4–6 partially densified compacts are initially formed by ball milling silicon nitride powder with about 5 wt. percent magnesium oxide as a sintering aid in tertbutyl alcohol. A weighed charge of the blended powder is then loaded into the lower portion of the die cavity 14 and pressed to form a compact 37 of approximately 50 percent of the final density by displacing the lower die punch 38 and an upper die punch (not shown) having a face shaped similar to that desired of one surface of the stator. A floating block 40 having a configuration of the blade on opposite sides is inserted in the die and the upper portion of the cavity is loaded with a similar weighed charge of the blended powder. The upper die punch 41 is placed in the die and displaced to cold press this further powder charge to form a further compact 42. The surface portions 44 and 46 of the die punches in contact with the compacts are shaped to conform to the uppermost surface of the stator blade 48 as generally shown in FIG. 6. The cold pressed compacts are hot pressed in the double-acting press for about 30 minutes at 1650° C. and at a pressure of 1000 psi in a nitrogen atmosphere. After completing the pressing, the die assembly is returned to ambient conditions and the two stator blades removed. Data from measurements and tests of the stator blades indicated a finished surface of 40–100 microinches within the desired dimensions of the finished article, an average density of 3.04 g/cc, which is 94.4 percent of full theoretical density. A density variance of ±9 percent was measured across the entire cross section of the stator blade 46 which had a standard deviation in blade thickness of only 0.3 mm.

It will be seen that the present invention provides a highly satisfactory method and for hot pressing articles of irregular cross section to a high uniform density with a high degree of dimensional accuracy. Further, the pressing of a plurality of shapes simultaneously in one operation by using the floating block results in a considerable reduction in fabrication costs and also eliminates the expensive machining of the finished products as heretofore required for the fabrication of the irregular shaped articles.

What is claimed is:

1. A method for hot pressing particulate refractory material into substantially uniformly dense articles of varying cross-sectional thicknesses, comprising the steps of confining a first compact of varying longitudinal thickness in a longitudinally extending die cavity, placing an essentially non-compressible block in the die cavity, placing a second compact of a size and configuration similar to that of said first compact in the die cavity to position said block therebetween in a contacting relationship with both of said compacts and to position the thicker portions of the second compact longitudinally opposite the thinner portions of the first compact, displacing die punches disposed at opposite sides of said die cavity with said compacts therebetween towards one another to press said compacts with said die punches having surfaces in contact with the compacts configured to uniformly bear against the surfaces defined by the thicker and thinner portions of the compacts, said block being oriented by said compacts prior to the pressing thereof so as to be rotated by the compacts upon the displacement of said die punches for maintaining substantially uniform volume displacements of the particulate material to substantially uniformly densify said compacts, and heating said compacts while being pressed by said die punches to a temperature sufficient to sinter the particulate material to form said articles.

2. The method claimed in claim 1, wherein said block is disposed between said compacts along a plane at an angle intermediate the longitudinal axis of the die cavity and an angle normal thereto prior to the displacement of said die punches, and wherein the rotation of the block by the displacement of said die punches is away from said longitudinal axis towards said thicker portions of each of said compacts to decrease the volume thereof at a greater rate than for said thinner portions.

3. The method claimed in claim 2, wherein said block has surface portions in said contacting relationship with said compacts of configurations corresponding to the desired shape of said article.

* * * * *